US008839951B2

(12) United States Patent
Glass et al.

(10) Patent No.: US 8,839,951 B2
(45) Date of Patent: Sep. 23, 2014

(54) FLIP BOOK CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/596,013

(22) Filed: Aug. 27, 2012

(65) Prior Publication Data

US 2013/0220863 A1 Aug. 29, 2013

Related U.S. Application Data

(60) Provisional application No. 61/527,133, filed on Aug. 25, 2011.

(51) Int. Cl.

| | |
|---|---|
| ***B65D 69/00*** | (2006.01) |
| ***B42D 15/00*** | (2006.01) |
| ***B65D 73/00*** | (2006.01) |

(52) U.S. Cl.

CPC ..... *B65D 73/007* (2013.01); *B42D 15/00* (2013.01); *B65D 73/0021* (2013.01)

USPC ..... 206/232; 40/124.06

(58) Field of Classification Search

USPC ..... 206/102, 39.3, 39.6, 39.4, 232, 531, 206/532, 535, 534.1, 461, 806; 40/124.12, 40/124.19

See application file for complete search history.

(56) References Cited

U.S. PATENT DOCUMENTS

| | | | | |
|---|---|---|---|---|
| 6,877,263 | B2 * | 4/2005 | Clark | 40/124.06 |
| 7,882,651 | B2 * | 2/2011 | Wilen | 40/124.06 |
| 2002/0100797 | A1 * | 8/2002 | Hollingsworth et al. | 229/92.8 |
| 2004/0206640 | A1 * | 10/2004 | Frenkel | 206/232 |

* cited by examiner

*Primary Examiner* — David Fidei
(74) *Attorney, Agent, or Firm* — Polsinelli PC

(57) ABSTRACT

An a card holder for holding a transaction card, such as a gift card, upon a card holding panel that pivots or flips to reveal the gift card in response to operation of a pull element. The holder may include multiple pages in addition to the card holding panel. The pull element is linked to a cover panel that, when opened, also causes the card holding panel to open.

5 Claims, 5 Drawing Sheets

FLIP BOOK CARD HOLDER

CROSS-REFERENCE TO RELATED APPLICATIONS

This application claims the benefit of the prior filed, provisional application, Ser. No. 61/527,133, filed Aug. 25, 2011, incorporated by reference herein.

BACKGROUND OF THE INVENTION

This invention relates generally to transaction card holders and more particularly to an assembly for holding a transaction card, such as a gift card, upon a panel that pivots to an upright position in response to operation of a pull element.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device that displays a gift card for purchase when hung upon a display rack within a predetermined and allotted display space but that converts to an enhanced gifting assembly after purchase, removal of the header panel, and installation of the gift card within the assembly.

BRIEF DESCRIPTION OF THE INVENTION

The purpose of this invention is to provide a card holder for holding a transaction card, such as a gift card, upon a panel that pivots or flips to reveal the gift card in response to operation of a pull element. The design of the holder mimics a small book and may include multiple pages, with the card holding panel mimicking one of the pages. A pull element or tab linked to the card holding panel causes the panel to move when the tab is pulled.

An embodiment in accordance with the present invention includes a transaction card holder assembly including a card holder, the card holder including a front flap and a hingedly connected rear flap. A pull tab is threaded through a portion of the rear flap to attach to a leaf. A header panel projects upward from the card holder. The header panel may be separated or defined from the card holder by perforations. Upon pulling the pull tab the leaf pivots upward from the plane of said the flap. A gift card may be removably attached to the leaf.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
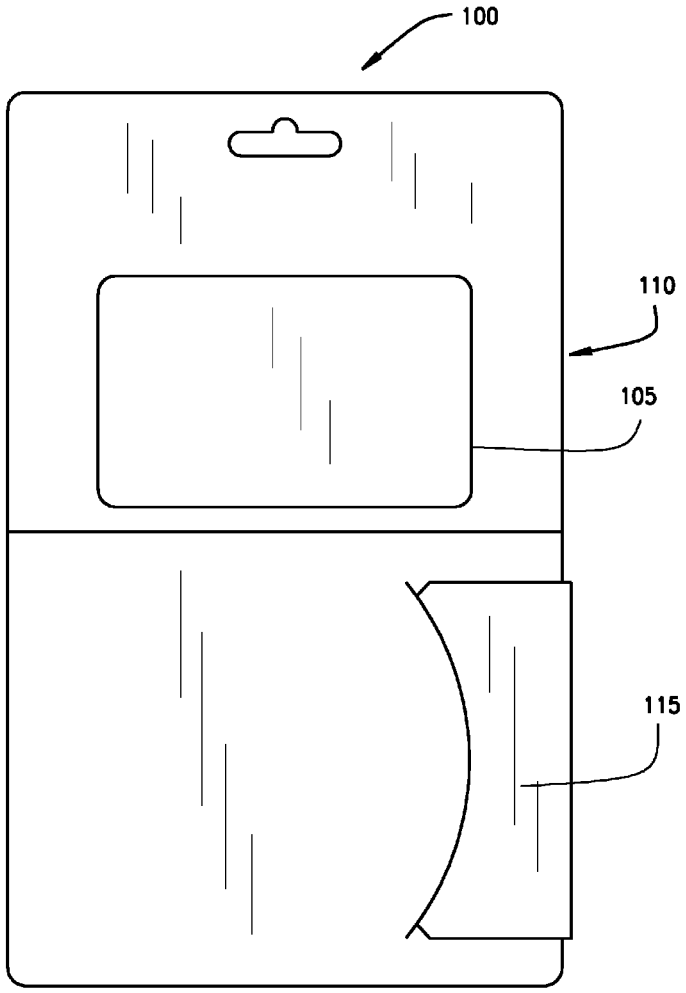
FIG. 1 is a front elevation showing the card holder in a closed disposition for display upon a merchant display rack.
Figure 2:
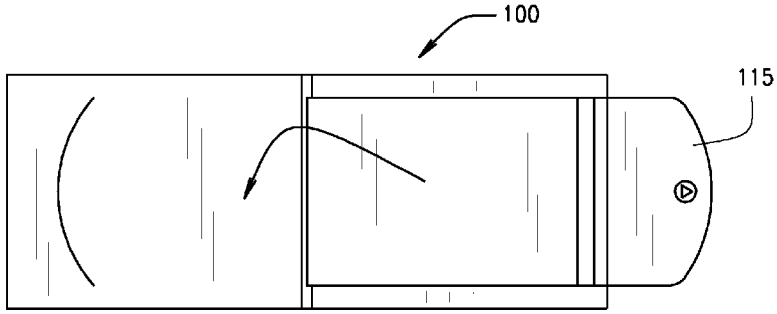
FIG. 2 is a front elevation showing the card holder in an open disposition but prior to engagement of the pull tab.
Figure 3:
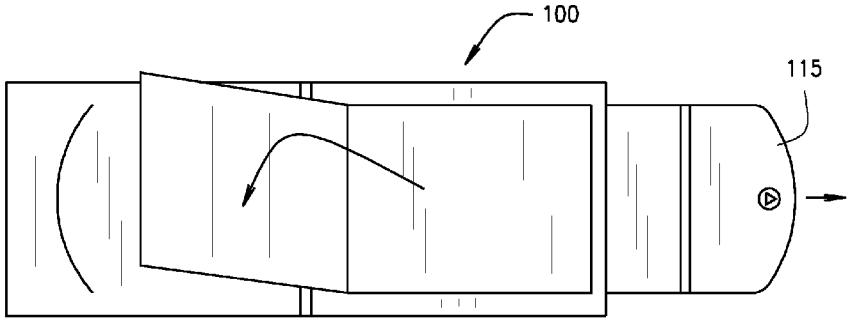
FIG. 3 is a front elevation showing the card holder in an open disposition and after partial engagement of the pull tab.
Figure 4:
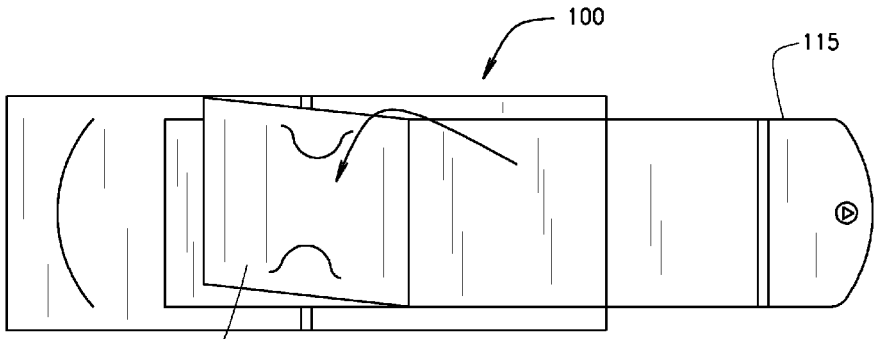
FIG. 4 is a front elevation showing the card holder in an open disposition and after full engagement of the pull tab.
Figure 5:
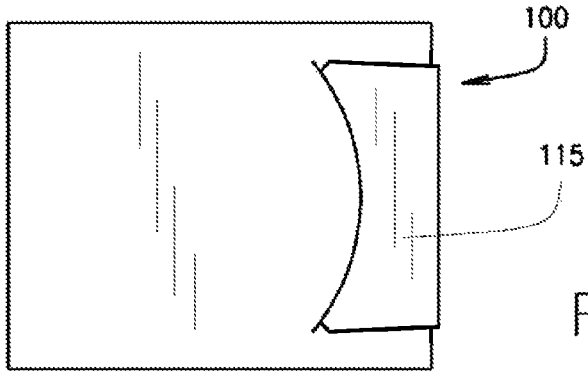
FIG. 5 is a front elevation showing the card holder in a closed disposition after removal of the header panel.
Figure 6:
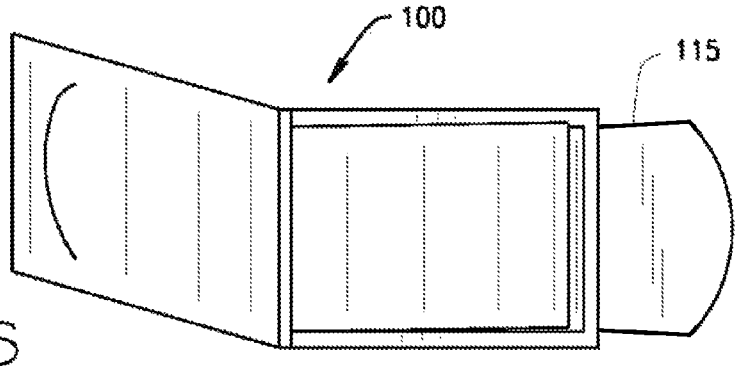
FIG. 6 is a front elevation showing the card holder in an open disposition but prior to engagement of the pull tab.
Figure 7:
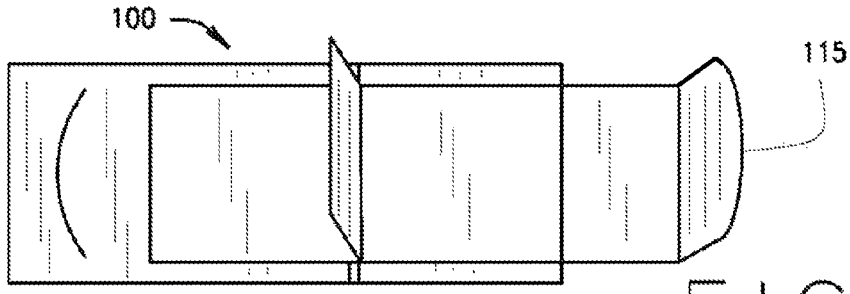
FIG. 7 is a front elevation showing the card holder in an open disposition and after partial engagement of the pull tab.
Figure 8:
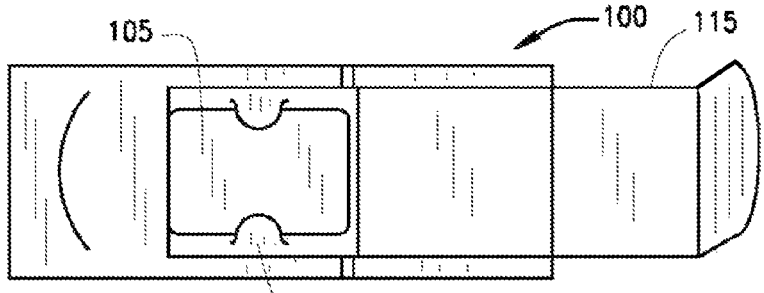
FIG. 8 is a front elevation showing the card holder in an open disposition and after full engagement of the pull tab.
Figure 9:
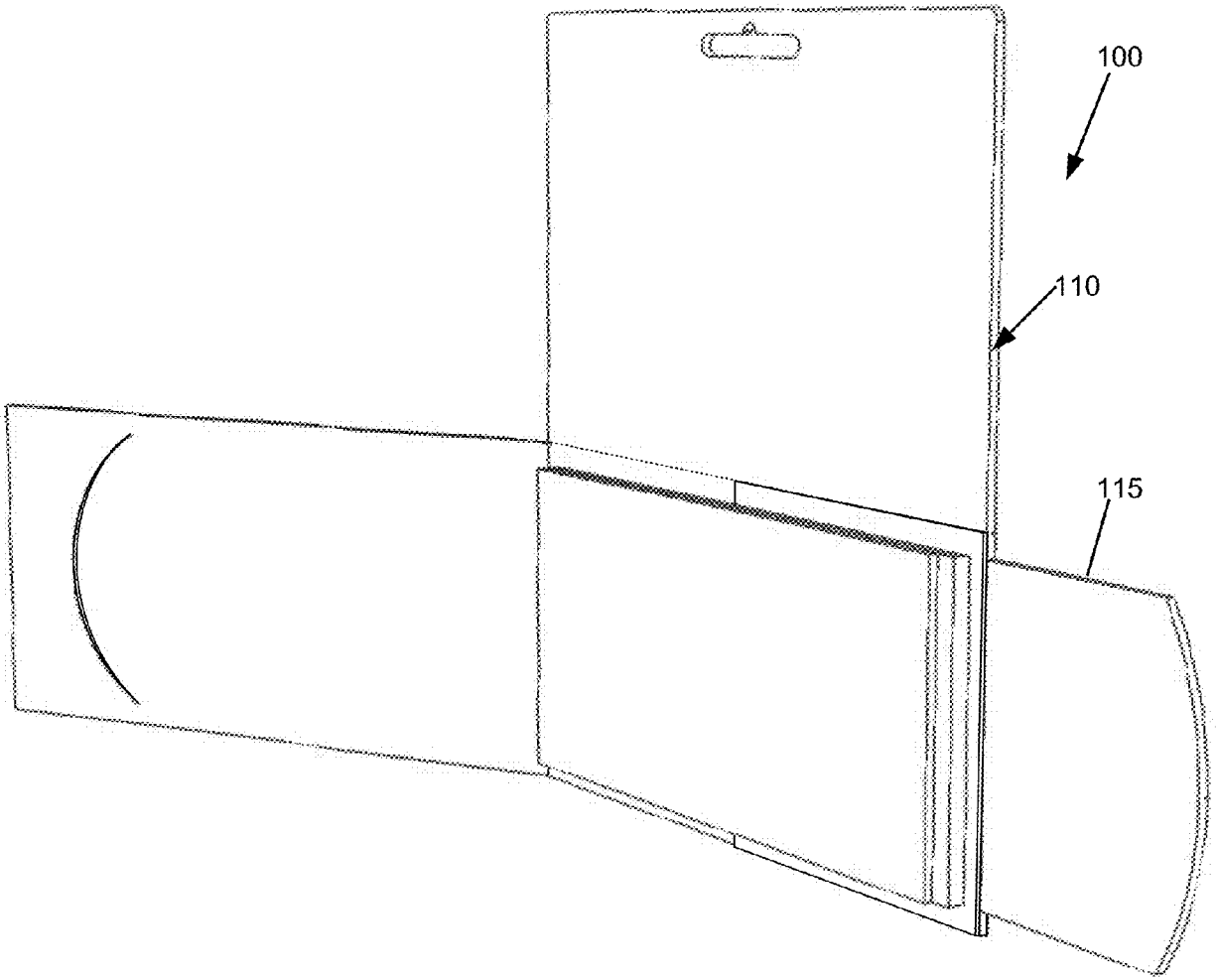
FIG. 9 is a perspective view of the card holder.
Figure 10:
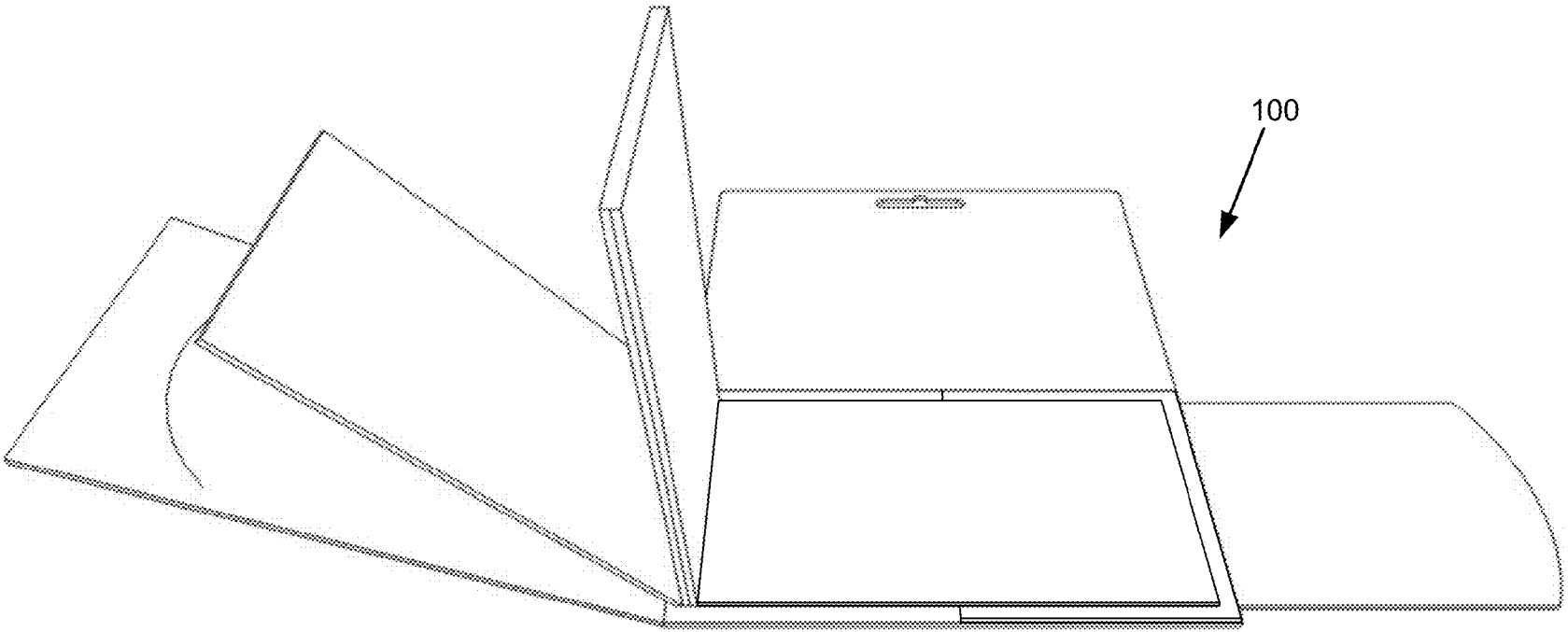
FIG. 10 is a perspective view of the card holder.

With reference to the figures, FIGS. 1-8 are illustrations of one or more embodiments of a card holder 100 for holding transaction cards, such as a gift card 105. FIG. 1 is a front elevation showing the card holder 100 in a closed disposition for display upon a merchant display rack. A header panel 110 projects upward from the card holder 100 and bears a gift card 105, which is removeably attached to the front surface of the header panel 110. FIGS. 2 and 6 are front elevations showing the card holder 100 in an open disposition but prior to engagement of the pull tab 115. FIGS. 3 and 7 are front elevations showing the card holder 100 in an open disposition and after partial engagement of the pull tab 115. FIGS. 4 and 8 are front elevations showing the card holder 100 in an open disposition and after full engagement of the pull tab 115.

As can be seen in FIGS. 4 and 8, one of the pages of the book that the holder 100 is designed to mimic comprises a card holder panel 120. The card holder panel 120 includes means for receiving and retaining the gift card 105 after removal of the gift card from the header panel 110.

Having thus described the invention, what is claimed as new and desired to be secured by Letters Patent is:

1. A transaction card holder assembly comprising:

a card holder, said card holder comprising:

a front flap hingedly connected to a rear flap at a first end of the rear flap;

a plurality of leaves pivotably coupled together along a common edge;

a pull tab threaded through a portion of said rear flap, where a distal portion of the pull tab is engaged to the plurality of leaves at the common edge and a proximal portion extends away from the rear flap; and a header panel engaged to and projecting away from said card holder, said header panel separable from said card holder by perforations; and whereby pulling said pull tab proximally away from the first end of the rear flap causes said plurality of leaves to pivot away from said rear flap.

2. The transaction card holder assembly of claim 1, wherein pulling said pull tab to a first partially extended position causes one of the plurality of leaves to pivot away from said rear flap, and pulling said pull tab to a second fully extended position causes at least one or more other leaf of the plurality of leaves to pivot away from said rear flap.

3. The transaction card holder assembly of claim 1, wherein the proximal portion of the pull tab has a width greater than the distal portion of the pull tab.

4. The transaction card holder assembly of claim 1, a gift card is removably engaged to the header panel.

5. The transaction card holder assembly of claim 1, a gift card is removably engaged to one of the plurality leaves.

* * * * *